US010946691B2

(12) United States Patent
Shih

(10) Patent No.: US 10,946,691 B2
(45) Date of Patent: Mar. 16, 2021

(54) EMBOSSER INCLUDING ROLLERS

(71) Applicant: SUN SAME ENTERPRISES CO., LTD., Tainan (TW)

(72) Inventor: Wen-Jer Shih, Tainan (TW)

(73) Assignee: SUN SAME ENTERPRISES CO., LTD.

( * ) Notice: Subject to any disclaimer, the term of this patent is extended or adjusted under 35 U.S.C. 154(b) by 193 days.

(21) Appl. No.: 16/161,037

(22) Filed: Oct. 15, 2018

(65) Prior Publication Data

US 2019/0111727 A1 Apr. 18, 2019

(30) Foreign Application Priority Data

Oct. 16, 2017 (TW) ..... 106135343
Jul. 17, 2018 (TW) ..... 107124655

(51) Int. Cl.
*B44B 5/00* (2006.01)
*B44B 5/02* (2006.01)

(52) U.S. Cl.
CPC ..... *B44B 5/0085* (2013.01); *B44B 5/0023* (2013.01); *B44B 5/0052* (2013.01); *B44B 5/026* (2013.01); *B44B 5/0038* (2013.01)

(58) Field of Classification Search
None
See application file for complete search history.

(56) References Cited

U.S. PATENT DOCUMENTS 1,471,688 A * 10/1923 Eyman ..... B44B 5/0033 101/31.1
1,590,976 A 6/1926 Hasselquist
2,077,853 A * 4/1937 Priesmeyer ..... B44B 5/0038 101/31.1
5,749,278 A * 5/1998 Lee ..... B26F 1/36 83/588
8,621,994 B2 1/2014 Shih
9,731,530 B1 8/2017 Shih
2014/0230624 A1 8/2014 Yen
2014/0311366 A1* 10/2014 Riegler ..... B44B 5/0052 101/28

OTHER PUBLICATIONS

The EPO Communication—Search Report, Application No. 17201890.5, dated Apr. 16, 2018.

* cited by examiner

*Primary Examiner* — Jill E Culler
(74) *Attorney, Agent, or Firm* — Su IP Consulting

(57) ABSTRACT

Embodiments of the disclosure set forth an embosser for a die. The embosser includes a frame having two sides. The embosser includes a handle and a roller body. The roller body includes a first roller in contact with the die and a second roller. In response to the handle being moved toward the roller body to a first handle position, the first roller is moved toward a first edge of the die and the second roller is in contact with the die. In response to the handle being moved toward the roller body to a second handle position from the first handle position, the first roller and the second roller remain in contact with the die and further press the die.

14 Claims, 13 Drawing Sheets

EMBOSSER INCLUDING ROLLERS

CROSS-REFERENCE TO RELATED APPLICATIONS

This application claims priority under 35 U.S.C. § 119 (a)-(d) to Taiwan Application No. 106135343 filed Oct. 16, 2017 and Taiwan Application No. 107124655 filed Jul. 17, 2018. Each of the Taiwan Applications is hereby incorporated by reference in its entirety. The application is also related to European Application No. 17201890.5, which is incorporated by reference in its entirety.

BACKGROUND

An embosser is commonly used by corporations, government offices, and notary publics. The embosser typically includes a frame, a handle pivotally coupled to the frame, and a roller coupled to the handle. A die is inserted into the frame and under the roller, and a piece of paper is inserted into the die. When the handle is depressed, it drives the roller down on the die to create a three-dimensional image or design on the paper. As shown in FIG. 12, an existing stamping machine includes an embosser 80 and a die 90 inserted to the embosser 80. The embosser 80 includes a frame 81, a handle 82 and a roller body 83. A fastening groove 811 is formed at a front end of the frame 81. The handle 82 is pivotally provided at the frame 81, and includes a handle portion 84, a first pivot shaft 85 and a first roller 86. The handle portion 84 is provided at the frame 81. The first pivot shaft 85 is provided at the frame 81 and passes through the handle portion 84. The first roller 86 is rotatably provided at the handle portion 84, and extends out of a bottom surface of the handle portion 84. The roller body 83 is pivotally provided at the frame 81 and located underneath the handle 82. The roller body 83 includes a second handle portion 87, a second pivot shaft 88 and a second roller 89. The second handle portion 87 is provided at the frame 81. The second pivot shaft 88 is provided at the frame 81 and passes through the second handle portion 87. In addition, the second pivot shaft 88 is located in front of the first pivot shaft 85. The second roller 89 is rotatably provided at the second handle portion 87 and extends out of a bottom surface of the second handle portion 87. The die 90 is provided at the fastening groove 811 of the frame 81, and abuts against the second roller 89.

As shown in FIG. 13, in conjunction with FIG. 12, during stamping, an object to be stamped 91 (e.g., paper) may be inserted into the dye 90. A user can hold and press the first handle portion 84 of the handle 82 downwardly, such that the first roller 86 downwardly presses the second handle portion 87 of the roller body 83 to actuate the second roller 89 pressing downwardly to the die 90. Therefore, the die 90 clamps and stamps the object to be stamped 91. The above existing single-point downwardly pressing approach associated with the second roller 89 of the embosser 80 may lead an uneven force distribution on die 90, resulting in an unclear stamping pattern on object 91.

Further, the embosser 80 uses only the first pivot shaft 85 and the second pivot shaft 88 as moment fulcrums. As a result, a user of the embosser 80 needs to apply a large force to stamp patterns on object 91 and should expect to receive a large counteracting force while stamping on object 91 as well.

SUMMARY

Embodiments of the present disclosure set forth an embosser for a die. The embosser includes a frame having two sides. The embosser includes a handle and a roller body. The roller body includes a first roller in contact with the die and a second roller. In response to the handle being moved toward the roller body to a first handle position, the first roller is moved toward a first edge of the die and the second roller is in contact with the die. In response to the handle being moved toward the roller body to a second handle position from the first handle position, the first roller and the second roller remain in contact with the die and further press the die.

BRIEF DESCRIPTION OF THE DRAWINGS

operation schematic diagram of an embosser when not being pressed downwardly

DETAILED DESCRIPTION

Figure 1:
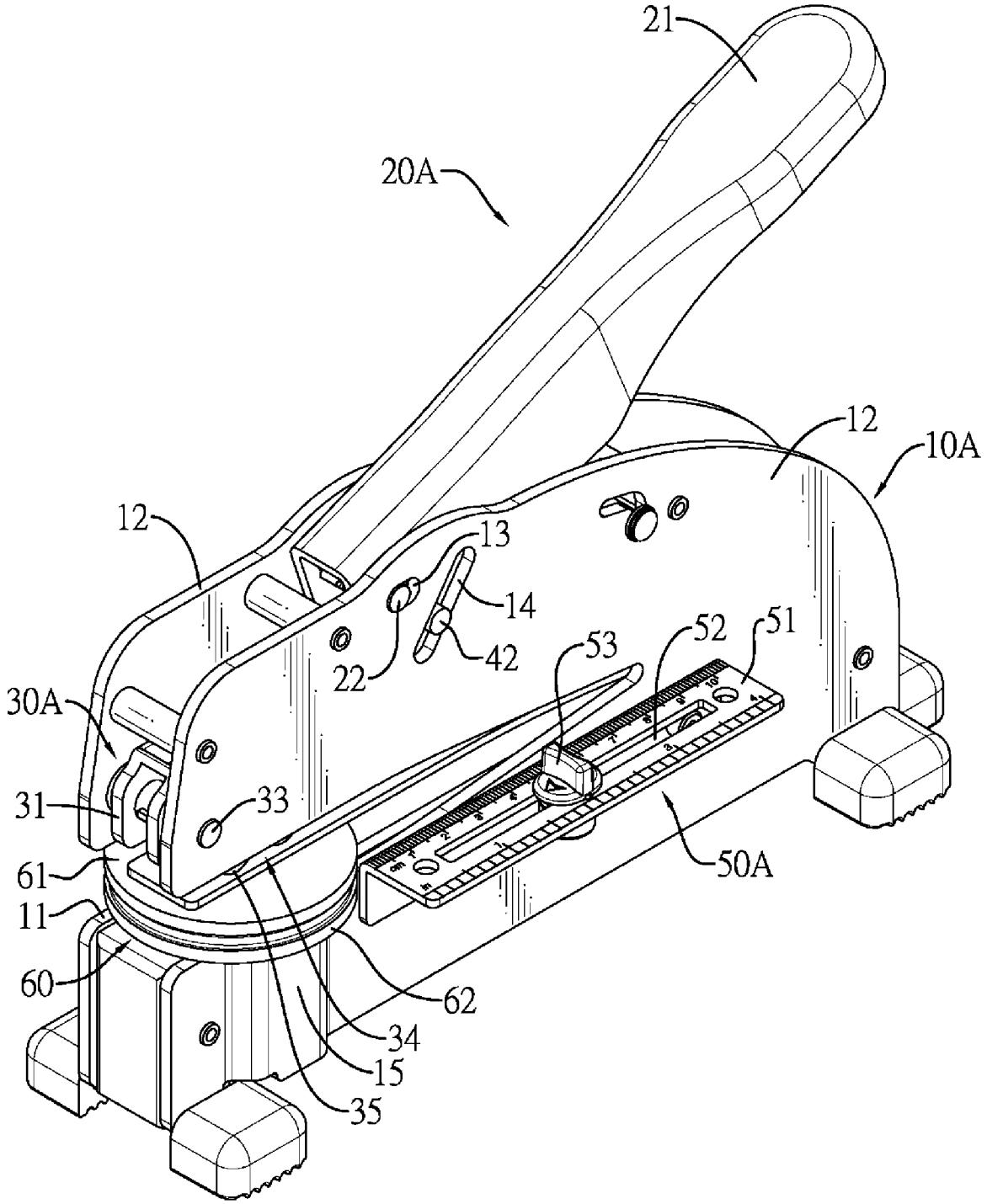
FIG. 1 is a perspective assembly schematic diagram of an embosser.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

The present disclosure relates to an embosser of a stamping machine, and more particularly to an embosser capable of facilitating the distribution of a force applied to the die and the paper.

Figure 2:
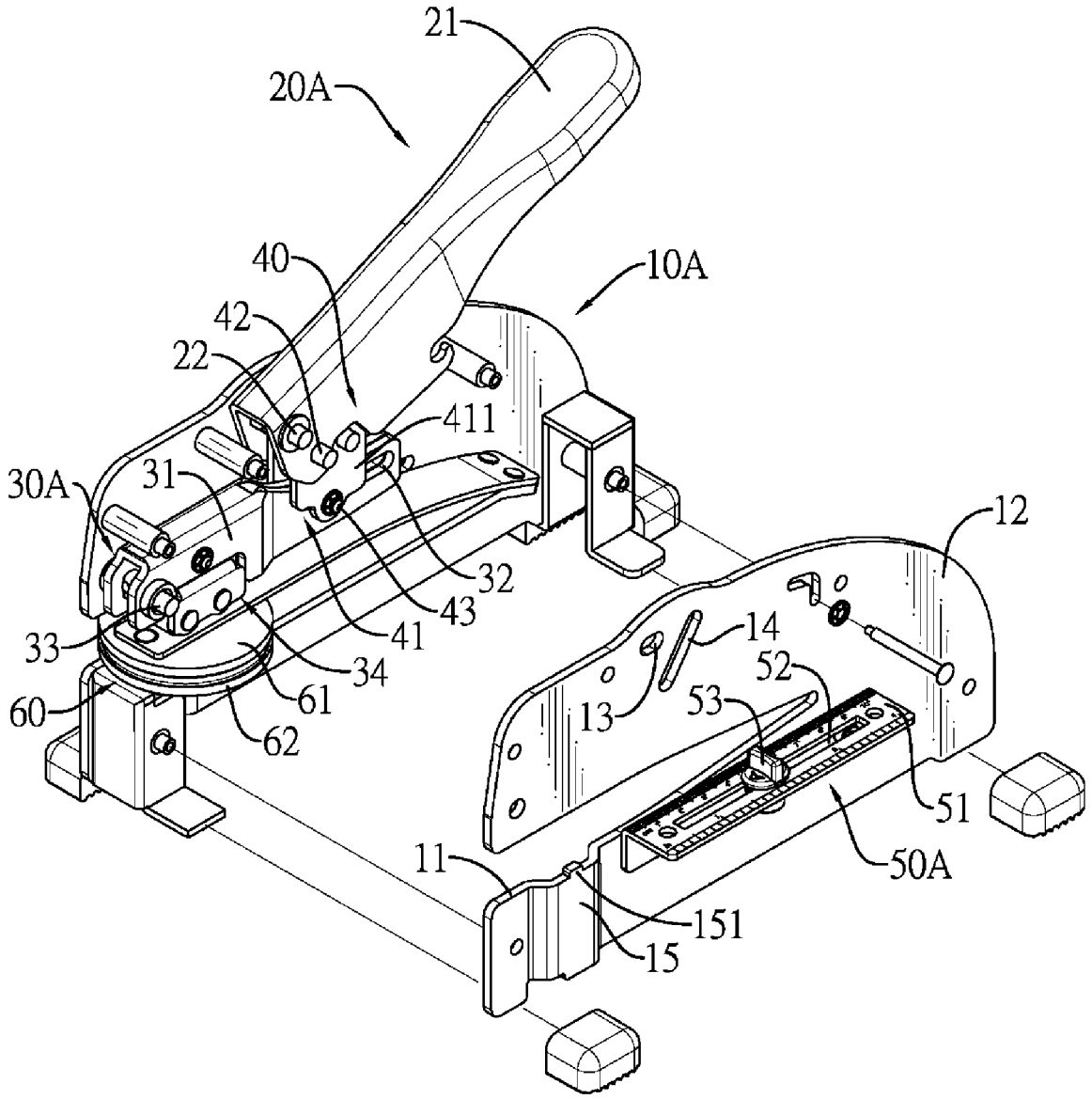
FIG. 2 is an exploded assembly schematic diagram of an embosser.
Figure 3:
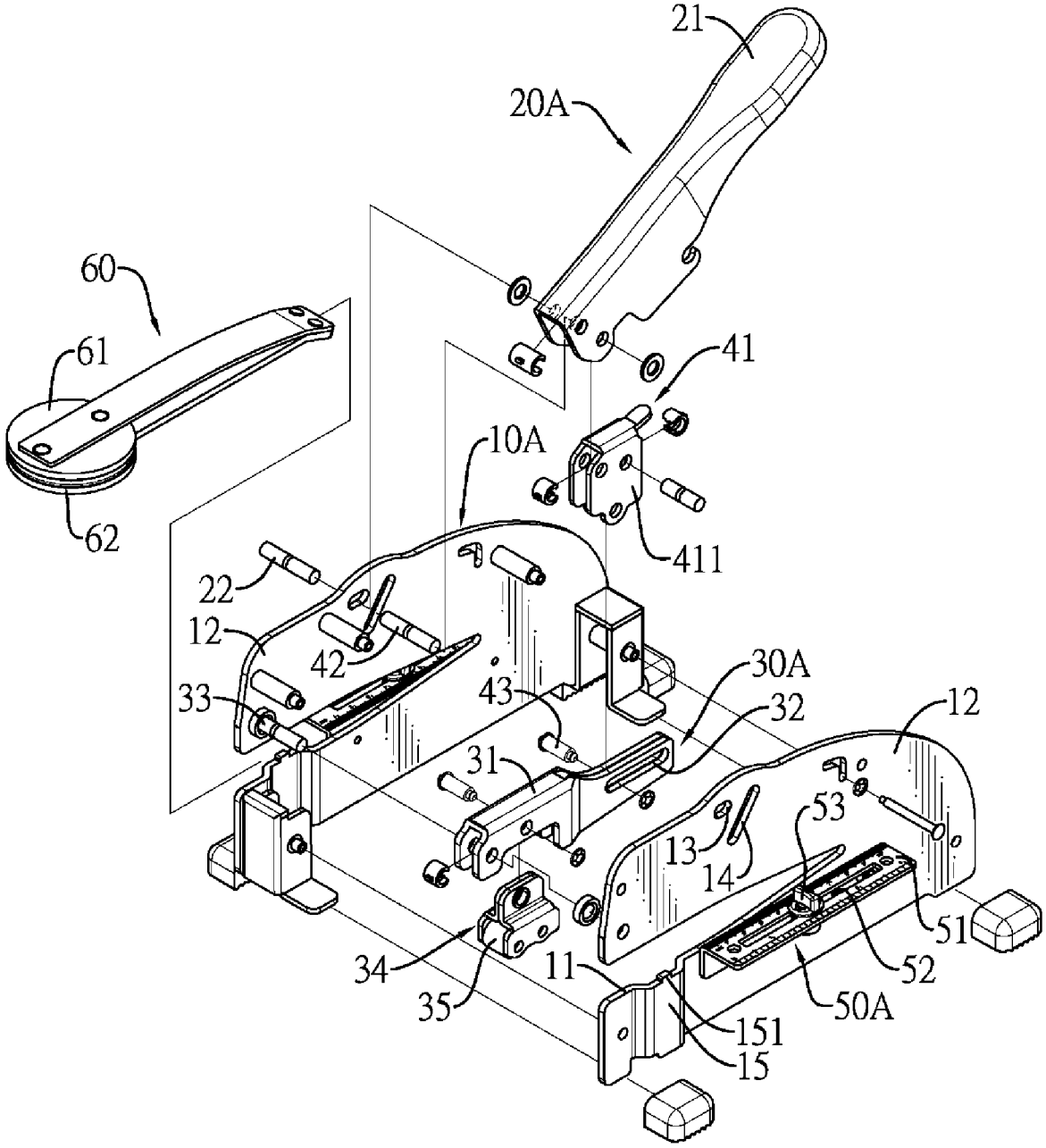
FIG. 3 is an exploded perspective schematic diagram of an embosser.

FIG. 1 is a perspective assembly schematic diagram of an embosser. FIG. 2 is an exploded assembly schematic diagram of the embosser. FIG. 3 is another exploded assembly schematic diagram of the embosser. These figures are all arranged according to some embodiments of the present disclosure. The embosser includes a frame 10A, a handle element 20A, a roller body 30A, a fastening groove 11 formed at a front end of the frame 10A, two sides 12 provided at an interval of the frame 10A, a first pair of slots 13 provided on the two sides 12 and located above the fastening groove 11, a support portion 15 protruding outwardly at each of the side 12, and a protrusion 151 formed at a top surface of the support portion 15.

As shown in FIG. 3, the handle element 20A is pivotally provided at the frame 10A, and includes a handle 21 and a first pin 22. The handle 21 is provided at the frame 10A. The first pin 22 is provided at the first pair of slots 13 of the frame 10A, and passes through the handle 21.

The roller body 30A is provided at the frame 10A and located below the handle element 20A. The first roller body 30A includes a second handle portion 31, a third pin 33 and a pressing unit 34. The second handle portion 31 is provided at the frame 10A. The third pin 33 is provided at the frame 10A and passes through the second handle portion 31. The pressing unit 34 is provided at a front side of the second handle portion 31 and extends out of a bottom surface of the second handle portion 31. In addition the pressing unit 34 includes two rollers 35 arranged at an interval in a front-back manner.

Figure 4:
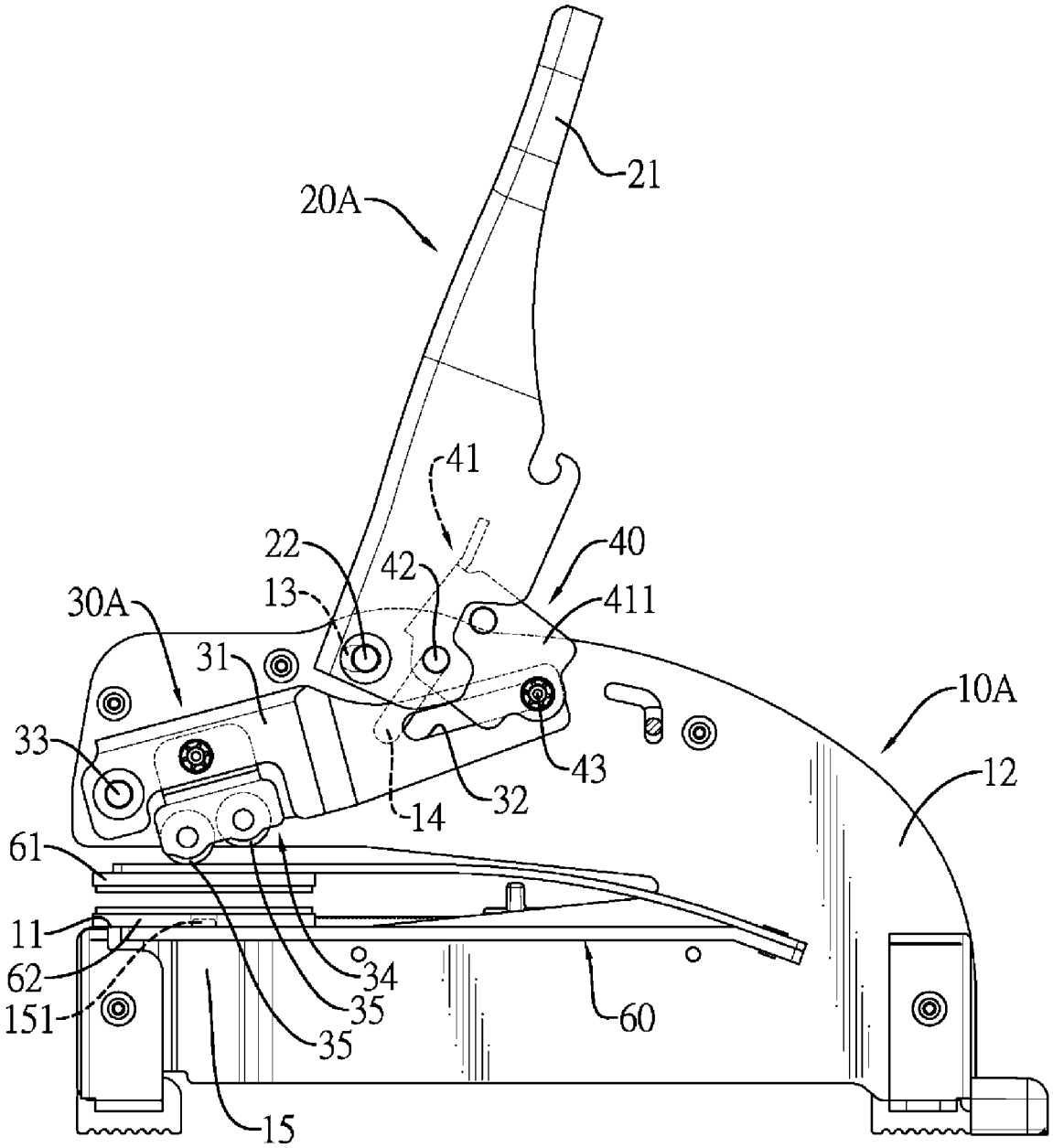
FIG. 4 is an operation schematic diagram of an embosser when not being pressed downwardly.
Figure 5:
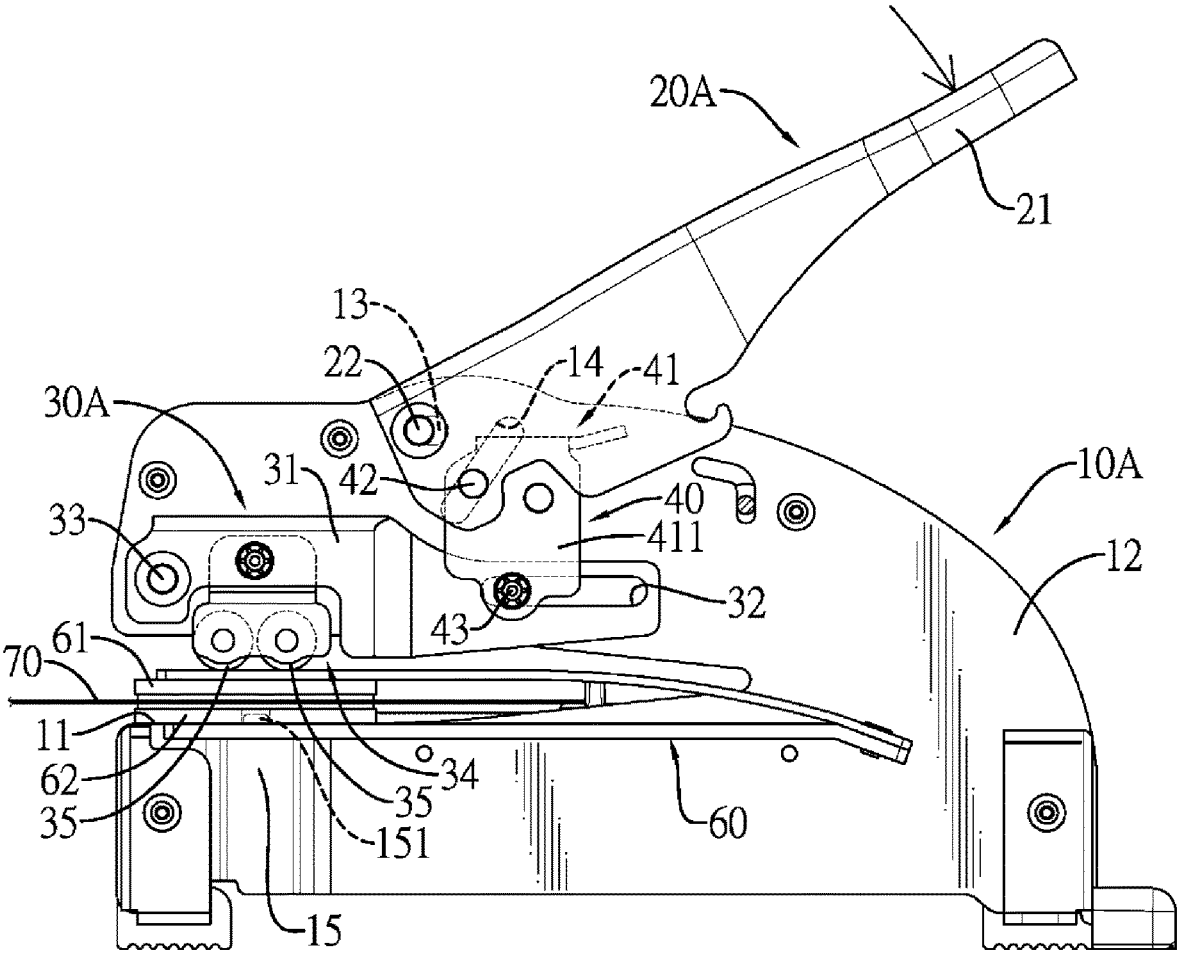
FIG. 5 is an operation schematic diagram of an embosser when being pressed downwardly

FIG. 4 is an operation schematic diagram of an embosser when not being pressed downwardly and FIG. 5 is an operation schematic diagram of an embosser when being pressed downwardly, all arranged according to some embodiments of the present disclosure.

A second pair of slots 14 is provided on the two sides 12. The second pair of slots 14 are located above the fastening groove 11 and at a back side of the first pair of slots. The roller body 30A includes a guide channel 32, which is formed at a back side of the roller body portion 31 and located below the handle element 20A. The embosser further includes a conversion unit 40. The conversion unit 40 is pivotally provided at the handle element 20A and connected to the roller body 30A. The conversion unit 40 includes a conversion member 41, a guide rod 42 and a press rod 43. The conversion member 41 is provided at the first handle 21. The guide rod 42 is provided at the conversion member 41 and passes through the handle 21. In addition, the guide rod 42 extends into the second pair of slots 14 of the frame 10A. The press rod 43 is provided at the conversion member 41 and extends into the guide channel 32 of the roller body 30A. A distance between a center of axis of the press rod 43 and a center of the guide rod 42 is greater than a distance between the center of axis of the guide rod 42 and a center of axis of the first pin 22. Further, the conversion member 41 includes two side plates 411 provided at an interval, and the second handle portion 31 extends to between the two side plates 411.

The embosser is provided with measuring rulers 50A on the two sides 12 of the frame 10A. The two measuring rulers 50A may be symmetrical, and may each include a base plate 51 having a scale, a sliding groove 52 and a stop block 53. The base plate 51 may be connected to the frame 10A. The sliding groove 52 may be formed at the base plate 51, and the stop block 53 may be provided at the base plate 51 and extend into the sliding groove 52. The measuring rulers 50A are adjacent to the fastening groove 11 of the frame 10A.

A die 60 is assembled at the fastening groove 11 of the embosser. The die 60 includes an upper mold 61 and a lower mold 62. The two protrusions 151 are extended into the lower mold 62 of the die 60 to position the die 60. The top surfaces of the two support portions 15 are abutted against the lower mold 62, so as to increase a contact area and hence stability. Moreover, as shown in FIG. 5, during a stamping process, an object 70 to be stamped is placed between the upper mold 61 and the lower mold 62.

In FIG. 4, when the embosser is not in operation, the first pin 22 abuts against a rear end of the first pair of slots 13, the guide rod 42 of the conversion unit 40 abuts against an upper end of the second pair of slots 14, the press rod 43 of the conversion unit 40 abuts against a rear end of the guide channel 32 of the roller body 30A, and the handle element 20A lifts the roller body 30A through the conversion unit 40. Therefore, a rear side of the second handle portion 31 tilts upwards and one of the press wheels 35 between the pressing unit 34 abuts against the upper mold 61 of the stamping unit 60.

In FIG. 5, during a stamping process, the object 70 to be printed is extended to between the upper mold 61 and the lower mold 62, and a user can apply a force on the handle 21 of the handle element 20A. Thus, the handle 21 regards the first pin 22 as a moment fulcrum and rotates, the first pin 22 rotates along with the handle element 20A and moves towards a front end of the first pair of slots 13. The first pin 22 further abuts against the front end of the first pair of slots 13. When the conversion member 41 rotates along with the handle 21, the guide rod 42 moves along the second pair of slots 14 towards a lower end of the second pair of slots 14 and moves along with the press rod 43 along the guiding channel 32 of the second press rod 30A towards a front section of the guiding channel 32. Therefore, the conversion member 41 pivotally rotates with respect to the handle 21. Meanwhile, the direction of the force applied by the conversion member 40 on the second handle portion 31 changes from a slanting direction to a downward direction, and the pressing unit 34 of the roller body 30A presses and applies a downward force on the upper mold 61 of the die 60 to perform stamping. During the stamping process, between the two rollers 35, the first roller 35A and the second roller 35B may distribute the force on the die 60. Further, the two support portions 15 abut against the lower mold 62 may increase a contact area of the die 60 to the object 70 and enhance the stamping stability.

Figure 6:
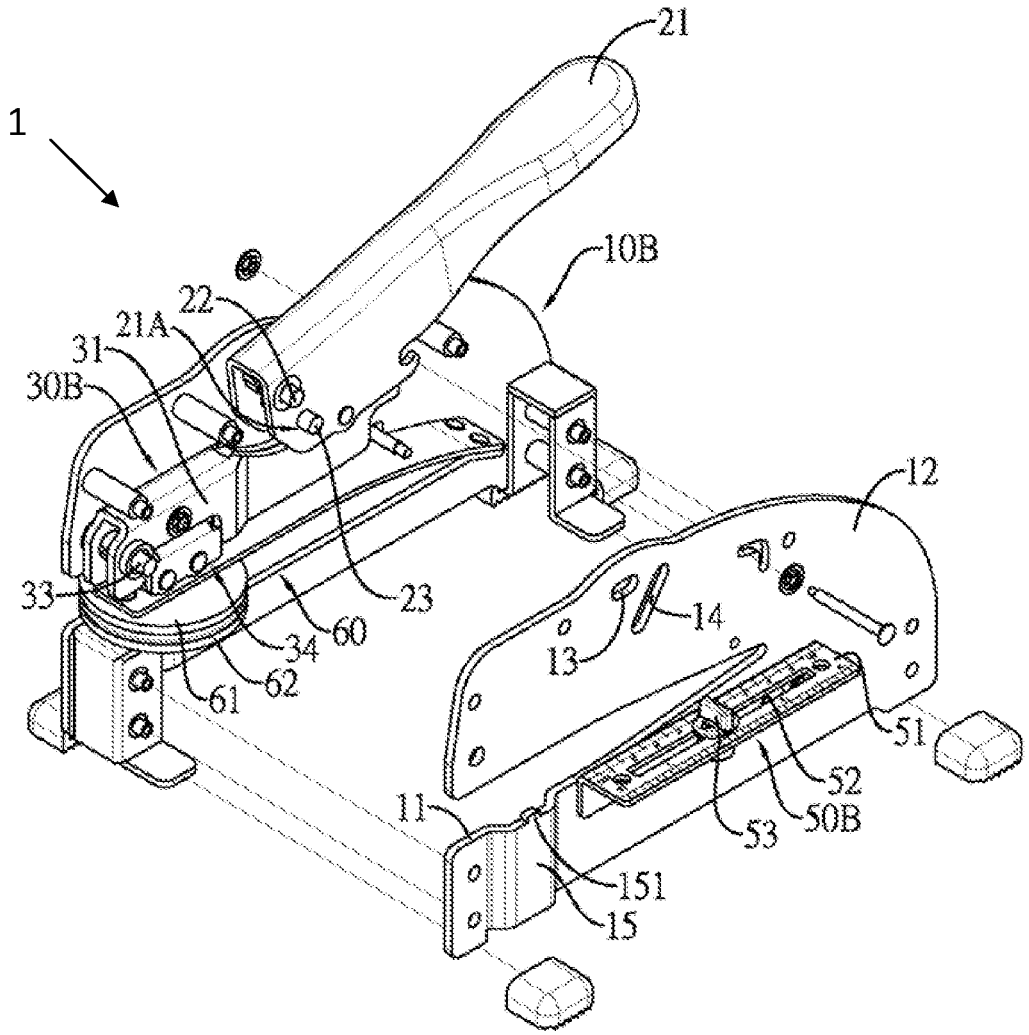
FIG. 6 is an exploded perspective schematic diagram of an embosser.
Figure 7:
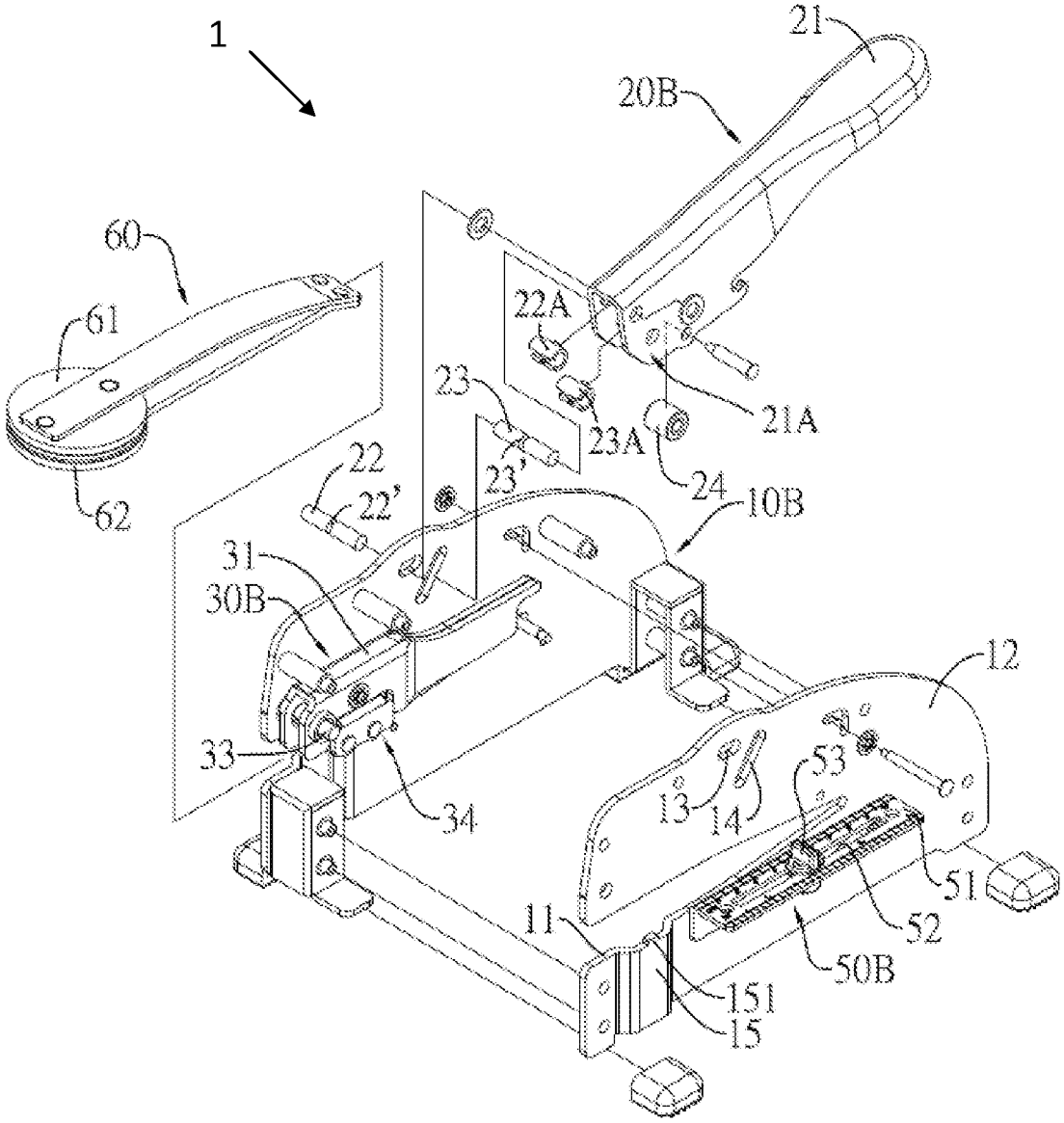
FIG. 7 is another exploded perspective schematic diagram of an embosser.

FIG. 6 is an exploded perspective schematic diagram of an embosser 1 according to some embodiments of the present disclosure. FIG. 7 is another exploded perspective schematic diagram of the embosser 1 according to some embodiments of the present disclosure.

In some embodiments, in FIG. 6, the embosser 1 includes a frame 10B having two complementary sides 12. The embosser 1 may be used with a die 60. The die 60 includes an upper mold 61 and a lower mold 62. The embosser 1 includes a handle 21, a roller body 30B including a pressing unit 34, a first pin 22 coupling the handle 21 to the sides 12 of the frame 10B a first pair of slots 13 defined on the sides 12 of the frame 10B a second pin 23 coupling the handle 21 to the sides 12 of the frame 10B and a second pair of slots 14 defined on the sides 12 of the frame 10B.

In some embodiments, the handle 21 is configured to pivot with respect to the first pin 22. In addition, the first pin 22 is configured to move along the first pair of slots 13 in response to the pivoting of the handle 21. In some other embodiments, the second pin 23 is movable along the second pair of slots 14 in response to the handle 21 pivoting with respect to the first pin 22.

In some embodiments, in FIG. 7, the embosser 1 further comprises a first retaining ring 22A. The first retaining ring 22A may be used with the first pin 22. In some embodiments, the first retaining ring 22A is configured to couple to a first pin groove 22' of the first pin 22 to couple the first pin 22 to the handle 21 adjacent to an end 21A of the handle 21.

In some embodiments, the embosser 1 further comprises a second retaining ring 23A. The second retaining ring 23A may couple to a second pin groove 23' of the second pin 23 to couple the second pin 23 to the handle 21 adjacent to an end 21A of the handle 21.

Figure 8:
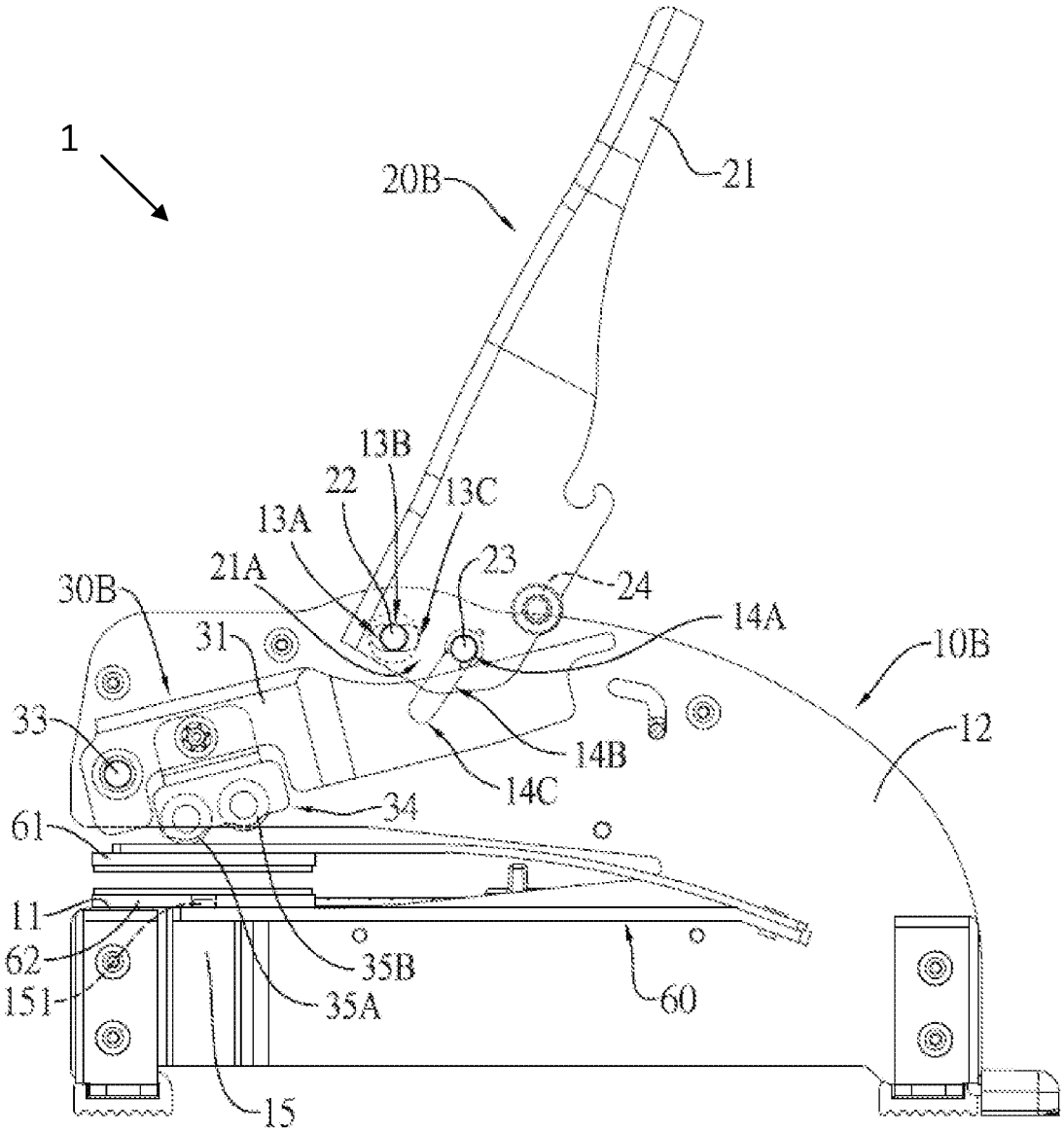
FIG. 8 is an operation schematic diagram of an embosser in response to a handle being at an initial handle position.

FIG. 8 is an operation schematic diagram of the embosser 1 in response to the handle 21 being at an initial handle position, according to some embodiments of the present disclosure. In some embodiments, the pressing unit 34 includes a first roller 35A and a second roller 35B. In response to the handle 21 at the initial handle position, the first roller 35A is in contact with the die 60 and the second roller 35B is not in contact with the die 60. The first pin 22 is at an initial pin position 13B in the first pair of slots 13, and the second pin 23 is at a first end 14A in the second pair of slots 14.

Figure 9:
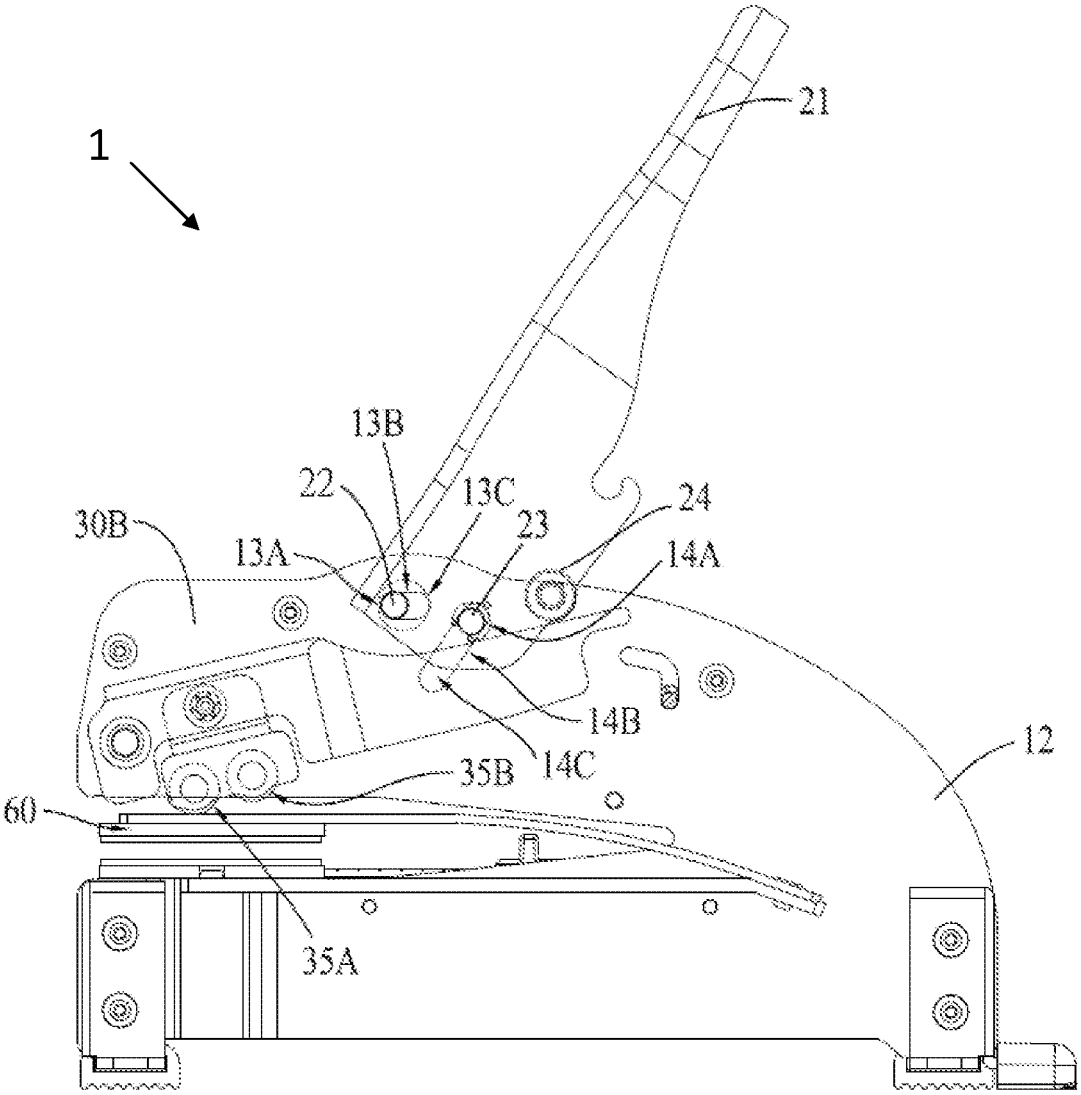
FIG. 9 is an operation schematic diagram of a embosser in response to a handle being moved downwardly from the initial handle position.

FIG. 9 is an operation schematic diagram of the embosser 1 in response to the handle 21 being moved downwardly from the initial handle position, according to some embodiments of the present disclosure. In response to the handle 21 being moved toward the roller body 30B, a third roller 24 is in contact with the roller body 30B and is configured to actuate the roller body 30B to move downwardly to the die 60. During the downward movement of the roller body 30B, the first roller 35A is configured to move toward a first edge of the die 60, and the first pin 22 moves from the initial pin position 13B to a first end 13A of the first pair of slots 13. In addition, the second pin 23 is configured to move from the first end 14A toward a middle point 14B of the second pair of slots 14.

Figure 10:
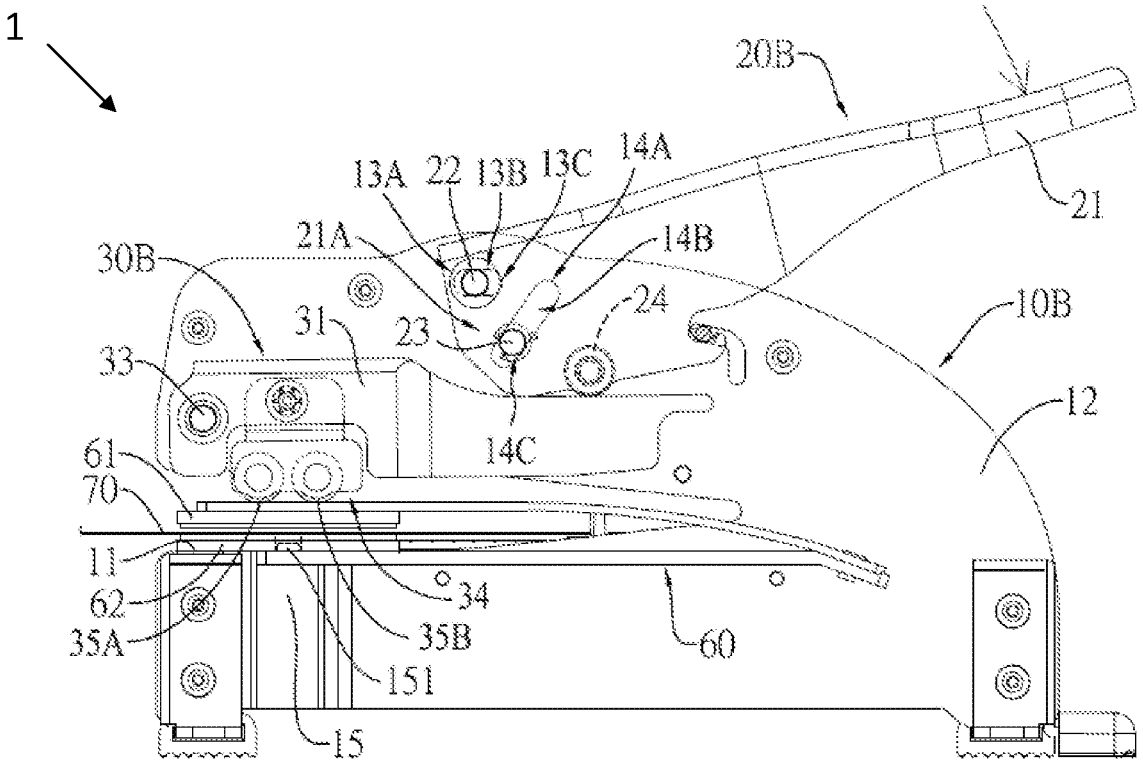
FIG. 10 is an operation schematic diagram of an embosser in response to a handle being moved to a first handle position.

FIG. 10 is an operation schematic diagram of the embosser 1 in response to the handle 21 being moved to a first handle position, according to some embodiments of the present disclosure. In response to the handle 21 being continuously moved toward the roller body 30B to a first handle position, the first roller 35A is configured to continuously move toward the first edge of the die 60 and the second roller 35B is in contact with the die 60 when the handle 21 is at the first handle position and the upper mold 61 is pressed by the first roller 35A and the second roller 35B to approach the object from a distance.

In some embodiments, the first pin 22 is moved from the first end 13A back toward to the initial pin position 13B in response to the handle 21 being moved to the first handle position. In some embodiments, in response to the handle 21 being moved to the first handle position, the second pin 23 moves toward a second end 14C of the second pair of slots 14.

Figure 11:
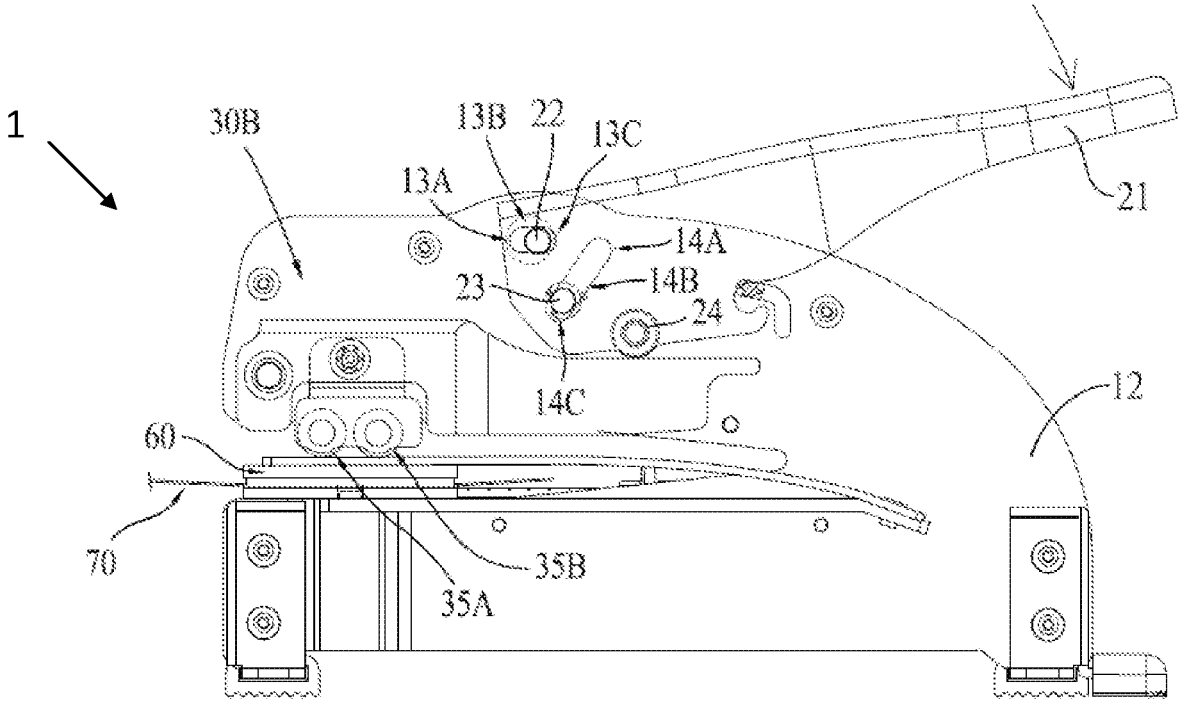
FIG. 11 is an operation schematic diagram of an embosser in response to a handle being moved to a second handle position, all arranged in accordance with some embodiments of the present disclosure.
Figure 12:
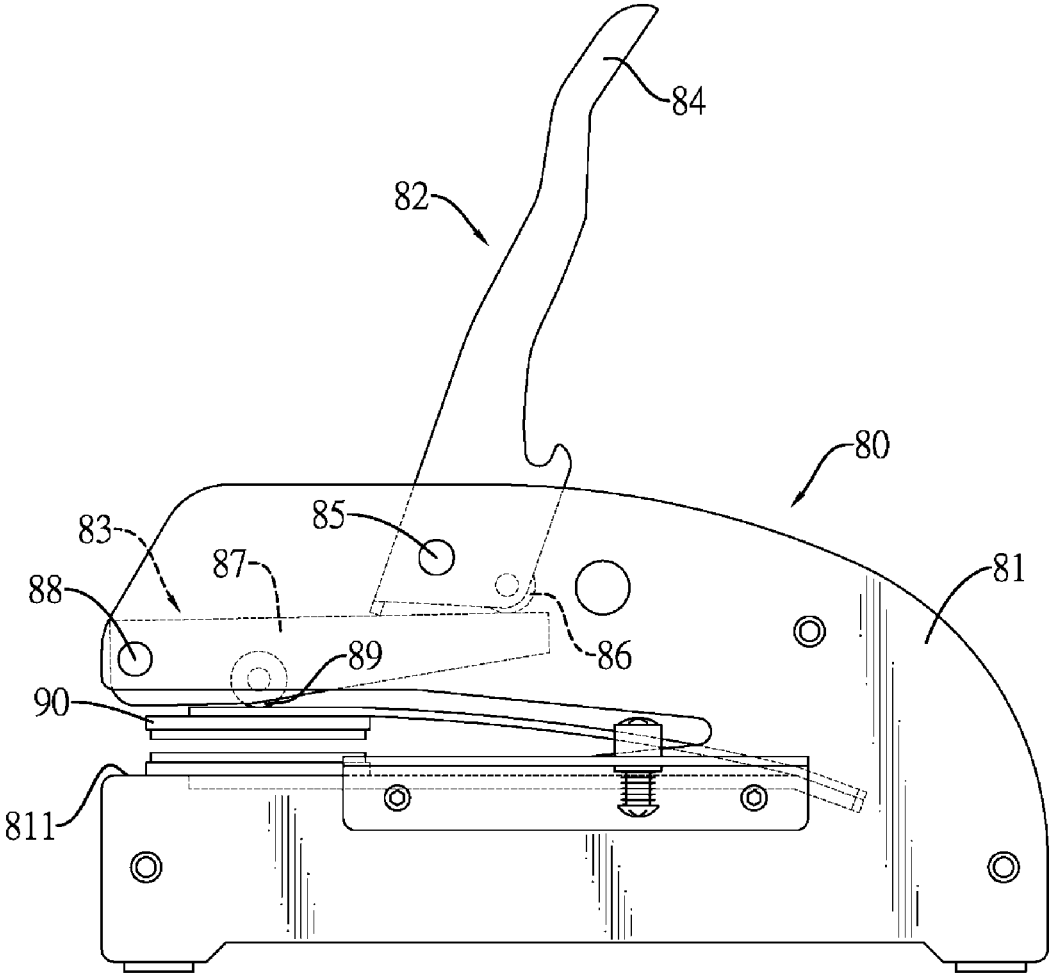
FIG. 12 is a planar side schematic diagram of an existing embosser.
Figure 13:
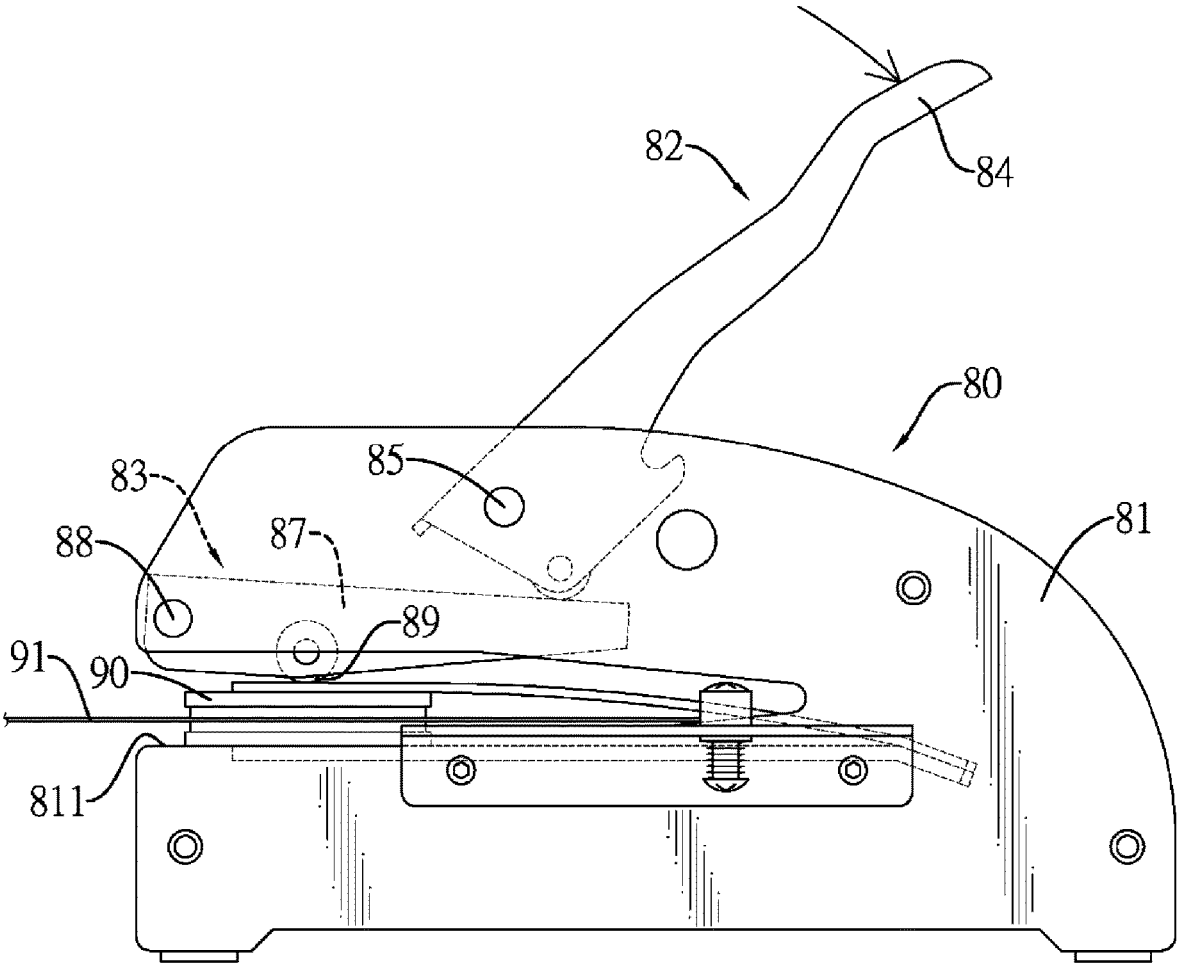
FIG. 13 is an operation schematic diagram of an existing embosser.

FIG. 11 is an operation schematic diagram of the embosser 1 in response to the handle 21 being moved to a second handle position, according to some embodiments of the present disclosure. In response to the handle 21 continuously being moved toward the roller body 30B to a second handle position after being at the first handle position, the second roller 35B remains in contact with the die 60. Therefore, the first roller 35A and the second roller 35B are jointly press the upper mold 61 to even distribute the force applied by the user on handle 21 over the entire die 60, instead of applying the force on a single point of die 60 in the existing approach illustrated in FIGS. 12 and 13 and described above. Accordingly, the clarity of the patterns stamped on the object 70 is enhanced.

In some embodiments, in response to the handle being moved from the first handle position to the second handle position, the first pin 22 is moved toward to a second end 13C of the first pair of slots 13 and the second pin 23 is moved approximately to the second end 14C of the second pair of slots 14.

In conclusion, the two rollers 35A and 35B are configured to evenly distribute the force applied by the user on handle 21 over the whole die 60 instead of applying the force on a single point of die 60 through one single roller 89.

Moreover, the first pin 22 may be used as a moment fulcrum. The movements of the first pin 22 in the first pair of slots 13 may adjust the direction of the force applied by the user on handle 21 and generate a downward momentum to the die 60, which will also enhance the clarity of the patterns stamped on the object 70.

I claim:

1. An embosser including a frame having two sides for a die, the embosser comprising:

a handle;

a roller body including a first roller in contact with the die and a second roller, wherein in response to the handle being at an initial handle position, the second roller is not in contact with the die;

in response to the handle being moved toward the roller body to a first handle position, the first roller is moved toward a first edge of the die and the second roller is in contact with the die; and in response to the handle being moved toward the roller body to a second handle position from the first handle position, the first roller and the second roller remain in contact with the die and further press the die.

2. The embosser of claim 1, the embosser further comprises a first pin coupling the handle to the sides.

3. The embosser of claim 2, wherein the handle pivots with respect to the first pin.

4. The embosser of claim 2, wherein the first pin is movable along a first pair of slots defined on the sides of the frame.

5. The embosser of claim 4, wherein the first pin is at an initial pin position in the slots in response to the handle being at the initial handle position.

6. The embosser of claim 5, wherein the first pin is moved from the initial handle position toward a first end of the slots and moved from the first end back toward to the initial pin position in response to the handle being moved from the initial handle position to the first handle position.

7. The embosser of claim 5, wherein the first pin is moved toward a second end of the slots in response to the handle being moved from the first handle position to the second handle position.

8. The embosser of claim 2, the embosser further comprises a first retaining ring coupled to the first pin to couple the first pin to the handle.

9. The embosser of claim 8, wherein the first retaining ring is coupled to a first pin groove defined on the first pin.

10. The embosser of claim 1, the embosser further comprises a second pin coupling the handle to the sides, wherein the second pin is movable along a second pair of slots defined on the sides.

11. The embosser of claim 10, wherein the second pin is moved from a first end of the second pair of slots toward a second end of the second pair of slots in response to the handle being moved from the initial handle position to the first handle position.

12. The embosser of claim 11, wherein the second pin is moved toward approximately to a second end of the second pair of slots in response to the handle being moved from the first handle position to the second handle position.

13. The embosser of claim 1, wherein the embosser further comprises a measuring ruler disposed on the sides.

14. The embosser of claim 1, wherein the embosser further comprises a third roller configured to actuate the roller body to move downwardly to the die in response to the handle being moved from the initial handle position to the first handle position.

* * * * *